US005904087A

United States Patent [19]

Freitas et al.

[11] Patent Number: 5,904,087

[45] Date of Patent: May 18, 1999

[54] BRAIDING MACHINE CARRIER WITH CLUTCH

[75] Inventors: Glenn Freitas, Foxboro; Kevin E. Keough, Canton; William J. Hurley, Jr., Belmont, all of Mass.; Richard Terrazzano, Salem, N.H.; Daniel Bullock, North Attleboro, Mass.

[73] Assignee: Foster-Miller, Inc., Waltham, Mass.

[21] Appl. No.: 08/900,943

[22] Filed: Jul. 28, 1997

[51] Int. Cl.[6] ..... D04C 3/48

[52] U.S. Cl. ..... 87/54; 87/39; 87/40; 87/50; 87/55; 87/56

[58] Field of Search ..... 87/16, 17, 37, 87/38, 39, 40, 50, 54, 55, 56

[56] References Cited

U.S. PATENT DOCUMENTS

| | | | |
|---|---|---|---|
| 4,070,911 | 1/1978 | Makin | 73/343 R |
| 4,084,479 | 4/1978 | Ratera | 87/48 |
| 4,275,638 | 6/1981 | DeYoung | 87/48 |
| 4,292,879 | 10/1981 | Kokubun | 87/57 |
| 4,494,436 | 1/1985 | Kruesi | 87/23 |
| 4,535,675 | 8/1985 | Bull et al. | 87/29 |
| 4,616,553 | 10/1986 | Nixon | 87/48 |
| 4,619,180 | 10/1986 | Moyer | 87/56 |
| 4,716,807 | 1/1988 | Fischer | 87/20 |
| 4,719,838 | 1/1988 | DeYoung | 87/57 |
| 4,736,668 | 4/1988 | Moyer | 87/57 |
| 4,903,574 | 2/1990 | Brown et al. | 87/57 |
| 4,913,028 | 4/1990 | Yoshiya | 87/44 |
| 4,984,502 | 1/1991 | Spain et al. | 87/8 |
| 5,146,836 | 9/1992 | DeYoung | 87/22 |
| 5,156,079 | 10/1992 | El-Shiekh et al. | 87/57 |
| 5,186,092 | 2/1993 | DeYoung | 87/22 |
| 5,220,859 | 6/1993 | DeYoung | 87/57 |
| 5,370,031 | 12/1994 | Koyfman et al. | 87/55 |
| 5,392,683 | 2/1995 | Farley | 87/8 |

*Primary Examiner*—William Stryjewski
*Attorney, Agent, or Firm*—Iandiorio & Teska

[57] ABSTRACT

A braiding machine carrier having a frame; a fiber spool mount attached to the frame; a fiber take-up assembly including a spiral spring; gear train on the frame for mechanically connecting the take-up spring assembly to the fiber spool mount for winding the spiral spring as a spool on the mount rotates; and a magnetic clutch, coupled to the take-up spring assembly, for preventing overwinding of the spiral spring.

21 Claims, 4 Drawing Sheets

BRAIDING MACHINE CARRIER WITH CLUTCH

FIELD OF INVENTION

The invention relates to a braiding machine carrier.

BACKGROUND OF INVENTION

Braiding machines, such as the Wardwell "New England Butt 2BX, 144 Carrier Round Braider", slightly modified, are being used by the applicant to produce flat braided fabrics used in composite materials. The carriers, which hold the spools of fiber/tow material on the braiding machine and come as standard components of the braiding machine, however, often preclude the use of higher modulus carbon and ceramic fibers because the fiber, as fed off the spool, proceeds along a fairly tortuous path that can cause fiber damage or even cause the carrier to fail during the braiding operation. Damaged braided fibers result in structures with reduced mechanical properties. Carrier failure results in expensive downtime. Also, with these prior art carriers, wider fibers and prepeg tows are very difficult to use because of carrier hardware size limitations and the tortuous fiber path.

Another shortcoming of the currently available carriers is that they only have a 3 inch take-up which, although satisfactory when braiders are used in the circular braiding configuration, is unsatisfactory when circular braiders are modified to produce flat braided fabrics.

SUMMARY OF INVENTION

It is therefore an object of this invention to provide an improved braiding machine carrier.

It is a further object of this invention to provide such an improved braiding machine carrier which reduces fiber damage, has a high take-up capacity, and increased fiber capacity.

It is a further object of this invention to provide such an improved braiding machine carrier in which the fiber is fed directly off the spool thereby eliminating the tortuous fiber feed path inherent in previous braiding machine carriers.

This invention results from the realization that the tortuous fiber feed path inherent in prior braiding machine carriers can be eliminated if the fiber is fed directly off the feed spool and the limited take-up of prior carriers greatly improved by mechanically coupling a spiral spring assembly to the feed spool and a clutch connected to the spiral spring assembly to prevent overwinding of the spiral spring assembly.

This invention features and may, depending on the specific implementation, comprise, include, or consist essentially of a braiding machine carrier. The carrier has a frame; a fiber spool mount attached to the frame; a fiber take-up assembly including a spiral spring which is wound as fiber is fed off the spool; means for mechanically connecting the fiber take-up assembly to the fiber spool mount for winding the spiral spring as a spool on the mount rotates; and clutch means, coupled to the fiber take-up assembly, for preventing overwinding of the spring. Prior devices lack such a frame and means for mechanically connecting the fiber take-up assembly to the spool.

The means for mechanically connecting typically includes a fiber spool mount gear attached to the frame and connected to the fiber spool mount, and a take-up gear attached to the frame and connected to the fiber take-up assembly. There is also an intermediate gear train mounted on the frame, the intermediate gear train having a first gear meshed with the take-up gear and a second gear meshed with the fiber spool mount gear.

The carrier preferably includes a feed-eye affixed to the frame for guiding fiber directly off a spool mounted on the fiber spool mount. The fiber spool mount includes a shaft rotatably affixed to the frame and a pair of spaced fiber spool seat members affixed to the shaft. The clutch means includes a housing affixed to the frame and a shaft rotatable with respect to the housing and coupled to the take-up assembly. The clutch is preferably a magnetic clutch with a variable tension setting. The fiber take-up assembly includes a shaft rotatably mounted with respect to the frame. There is a flexible coupling mounted on the fiber take-up assembly shaft for maintaining the fiber take-up assembly in the proper orientation. There is also a quick release mechanism for mounting the carrier to the braider machine.

This invention also features a braiding machine carrier comprising: a frame including a fiber spool mount; a fiber guide attached to the frame; means for feeding fiber off a spool on the mount directly through the fiber guide; and means for automatically reversing the direction of the spool in response to slack in the fiber fed off the spool thereby eliminating the tortuous fiber feed path of the prior carriers and also significantly increasing the take-up capacity of the carrier.

This invention also features a carrier in which the fiber spool mount, the fiber take-up assembly, and the clutch are all directly connected to each other and mounted on the frame. The fiber spool mount may be attached directly to the frame and alternatively, attached to the take-up assembly if the take-up assembly and the clutch are mounted to the frame.

DISCLOSURE OF PREFERRED EMBODIMENT

Other objects, features and advantages will occur to those skilled in the art from the following description of a preferred embodiment and the accompanying drawings, in which.

Figure 1:
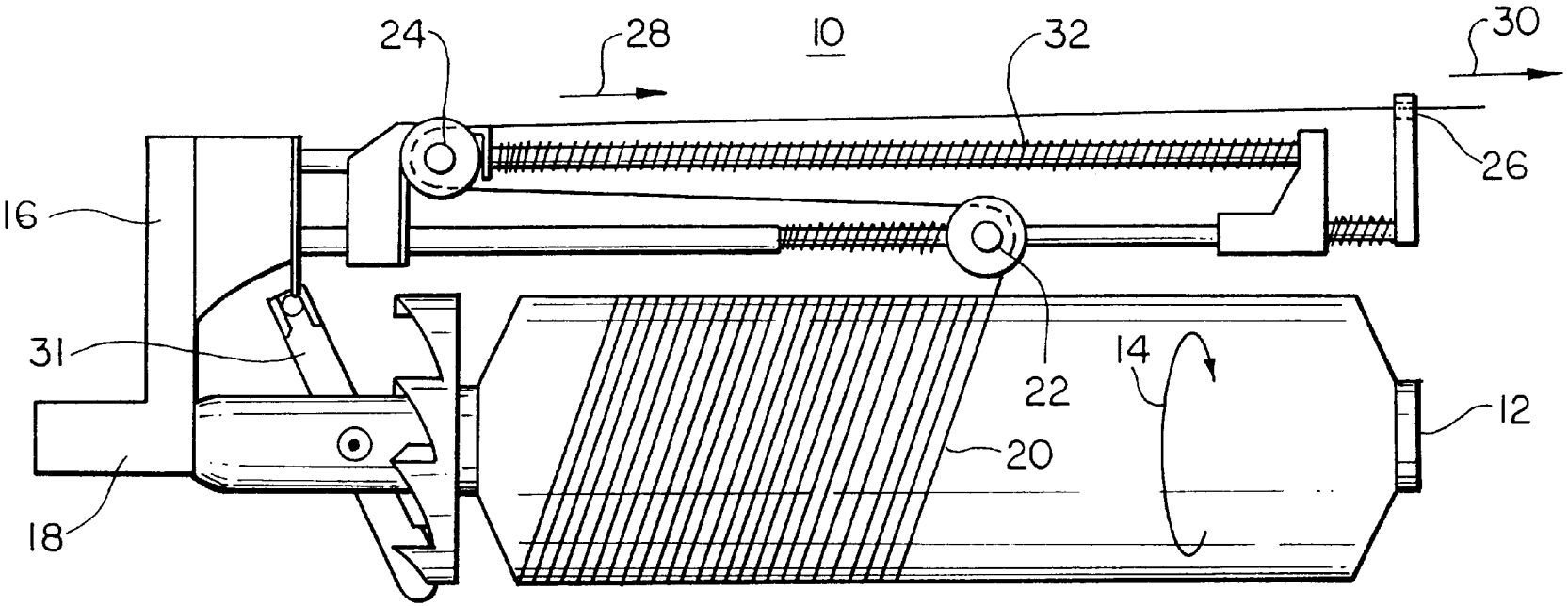
FIG. 1 PRIOR ART
FIG. 1 is a schematic view of a prior art braiding machine carrier.

Prior art braiding machine carrier 10, FIG. 1, such as a Wardwell "2BX" carrier, includes spool 12 which rotates in the direction shown by arrow 14. Frame member 16 includes carrier base 18 which mounts in a horndog of a gear in a commercial circular braiding machine. Fiber 20 is fed off a spool 12, around wheel 22 and also around moveable wheel 24 before passing through eyelet 26 as shown. Wheel 24 moves in the direction shown by arrow 28 when fiber 20 is under tension in the direction shown by arrow 30 compressing spring 32. When spring 32 is compressed to its maximum position, pawl 31 releases spool 12 for feeding out additional fiber. When the tension in the direction shown by arrow 30 is released, spring 32 drives wheel 24 back to the position shown thereby taking up any slack in the fiber.

As discussed in the Background of Invention above, this design suffers from two shortcomings. First, fiber 20 must travel a fairly tortuous path around wheels 22 and 24 before being fed off the carrier 10 thereby causing fiber damage if fiber 20 is a carbon or ceramic fiber or any wider type fiber or a prepeg tow used in composite materials. The strands of fiber become frayed on wheels 22 and 24 causing them to jam resulting in down time of the braiding machine. Also, the fibers tend to hop-off of wheels 22 and 24 causing carrier jamming. Moreover, wheels 22 and 24 are narrow and limit fiber tow width capacity. During the take-up process in a braiding operation, each section of the fiber will make multiple passes over roller 24 making the problem worse. It should be understood that there are a number of these carriers on a single braiding machine and each one must be extremely reliable and efficient at feeding fiber of the feed spool at a very quick rate. This prior art device also suffers from the limitation that the maximum take-up is dictated by the length of spring 32 in its relaxed state which is normally on the order of about 3 inches for the Wardwell "2BX" carrier. When a commercially manufactured circular braider is reconfigured to form a flat braid, there are times during each cycle of the machine when there is much more than 3 inches of slack in the fiber after it passes through eyelet 26. In summary, this prior art commercially available design was found not to be suitable for commercial braiding machines reconfigured to form a flat braid made of carbon, ceramic or other wider fibers and prepeg tows.

Figure 2:
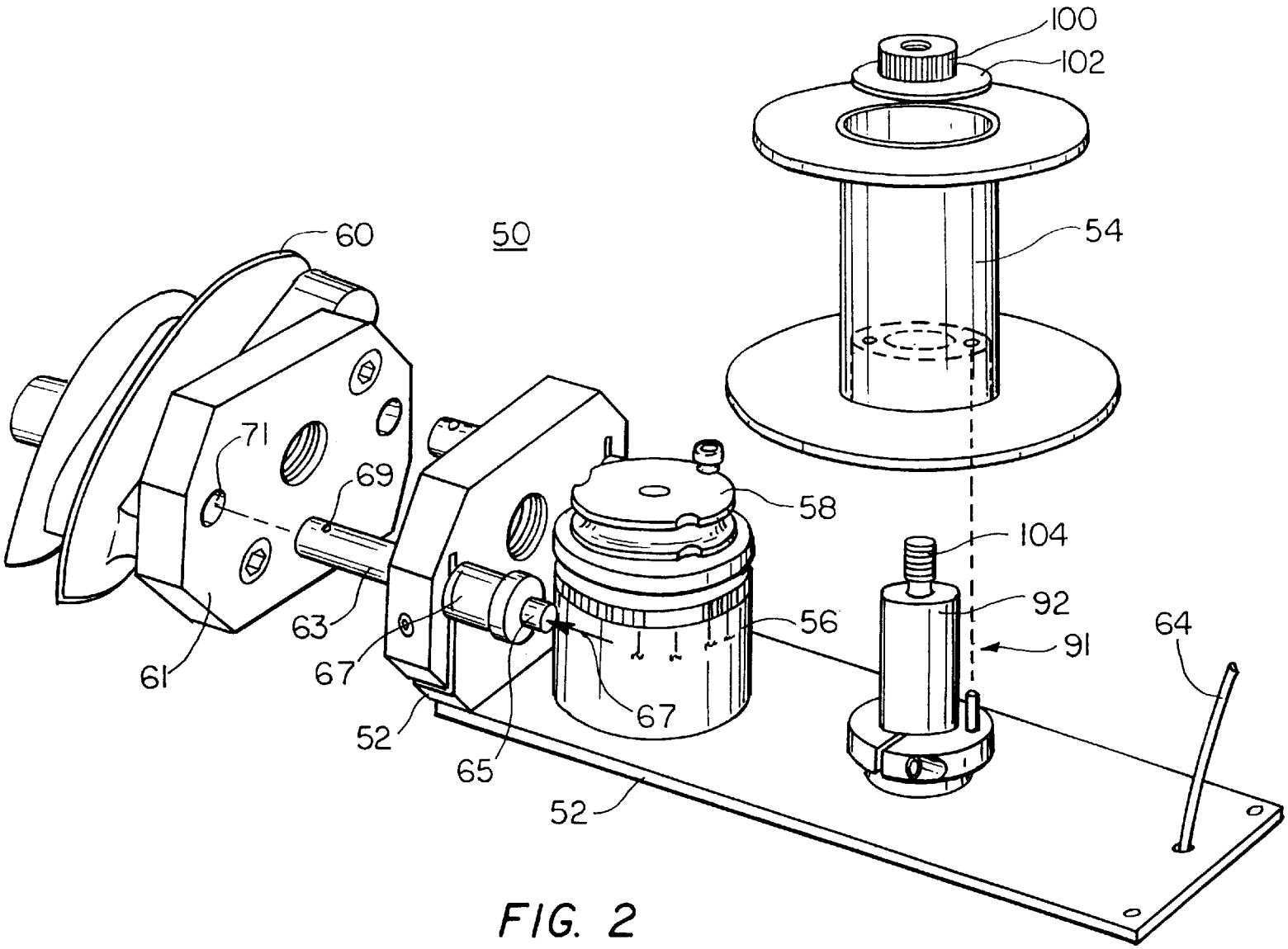
FIG. 2 is a schematic view of the direct feed, high take-up capacity braiding machine carrier of this invention.

Accordingly, horizontal braiding machine carrier 50, FIG. 2 of this invention features frame 52 which houses a fiber spool mount subassembly 91 for holding spool 54, fiber take up assembly 56, and magnetic clutch 58. Carrier base 60, similar to carrier base 18, FIG. 1, is affixed to one end of frame 52 as shown via plate 61 and quick release mechanism coupling assembly 63. Carrier 50 of this invention eliminates the tortuous path of fiber off the spool: fiber, which may be a carbon or ceramic fiber or even prepeg tow material, is fed directly off spool 54 through fiber guide eyelet 64.

Fiber take up assembly 56 includes an internal spiral spring which slowly winds as spool 54 pays out fiber during braiding. Upon reaching a preset release tension, the spiral spring stops winding and magnetic clutch 58 slips to let more fiber off the spool thereby preventing overwinding of the spiral spring. When the modified flat braider causes carrier 50 to reverse its direction and traverse back to the center of the braider, the spiral spring unwinds and takes up any slack fiber until the fiber begins to pay out again. Instead of the 3 inch take-up of prior art carrier 10, FIG. 1, carrier 50, FIG. 2 of this invention has a 60 inch take-up capacity. Significantly more take-up (100–200 inches) is also possible if larger spiral springs are used.

Figure 3:
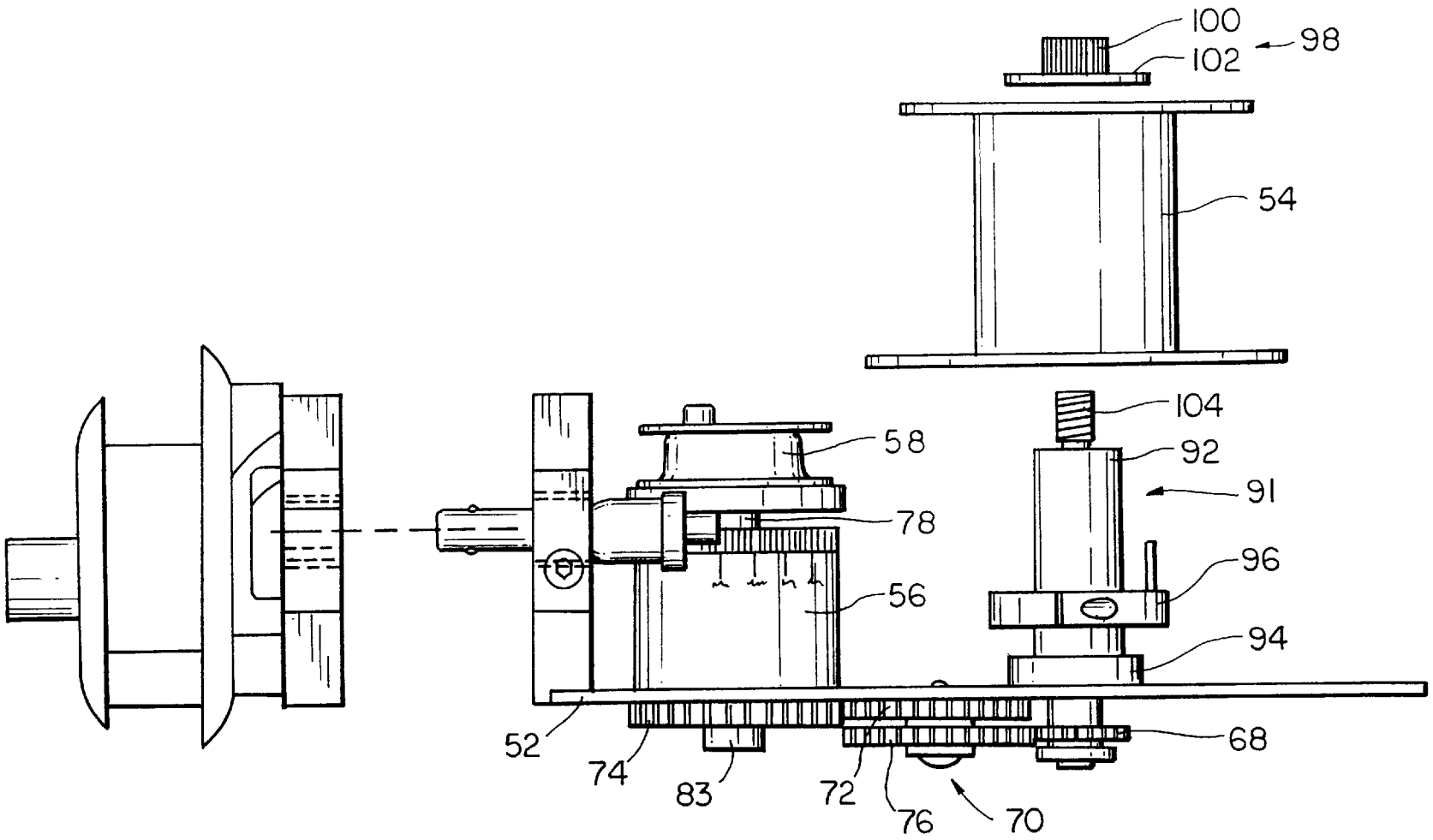
FIG. 3 is a top plan view of the braiding machine carrier shown in FIG. 2.

As spool 54 rotates in the direction shown by arrow 66, FIG. 3, gear 68 also rotates. Intermediate gear train assembly 70 includes first gear 72 having teeth meshed with take-up gear 74 and second gear 76 having teeth meshed with fiber spool carrier gear 68. Take-up gear 74 winds fiber take-up assembly 56 to a preset tension and thereafter magnetic clutch 58 slips letting more fiber off the spool. If there is slack in the fiber fed off spool 54, fiber take-up assembly 56 reverses direction causing gears 68, 72, 74 and 76 to reverse direction thereby winding any slack fiber back onto the spool. Shaft 78 of clutch 58 is coupled to take up spring assembly 56 which includes shaft 83 rotatable with respect to frame 52 and connected to gear 74.

As shown in more detail in FIG. 3, spool 54 is mounted on spool mount subassembly 91 which includes shaft 92 rotatably mounted with respect to frame 52. Gear 68 is affixed to one end of shaft 92. Spacer 94 is affixed to shaft 92 below bottom spool seat member 96. Top spool seat member 98 includes knurled hand nut 100 and washer 102 combination. To load spool 54, nut 100 is removed from the threaded end 104 of shaft 92. Spool 54 is placed over shaft 92 until the bottom end thereof rests on seat 96. Nut 100 is then tightened until the washer portion 102 firmly locks the spool in place.

Clutch 58 includes shaft 78 coupled to fiber take-up assembly 56 which has shaft 83 extending through frame 52 and terminating in gear 74. Intermediate gear train 70 includes first gear 72 meshed with take up spring gear 74 and second gear 76 meshed with fiber spool carrier gear 68. Clutch 58 may be a "Perma-Tork" clutch available from Magnetic Power Systems Inc. and fiber take-up assembly 56 may be a Ametek, Hunter Spring Division, model "ML-1565". After 30–40 revolutions of spool 54, clutch 58 begins turning to prevent overwinding of the spiral spring within fiber take-up assembly 56.

Carrier 50 is particularly useful for braiding higher modulus carbon and ceramic fibers because it eliminates the tortuous fiber path associated with prior art carriers which leads to excessive fiber damage during the braiding operation. In addition, the very limited 3 inch take-up with the prior art design is greatly improved and a 60 inch take-up is possible with carrier 50. Clutch 58 can also be set at different tension levels depending on the type of fibers on spool 55.

Quick release mechanism 63, FIG. 2, allows carrier frame 50 to be quickly disconnected from the braider and moved to another location or stored until its use is required. Quick release mechanism 63 includes biased shaft 65 within housing 67. Which shaft 65 is pushed in the direction of arrow 67, bearing 69 is released and then mechanism 63 can be withdrawn from hole 71 in plate 61. As shown, there are usually two such quick release mechanism per carrier.

Figure 4:
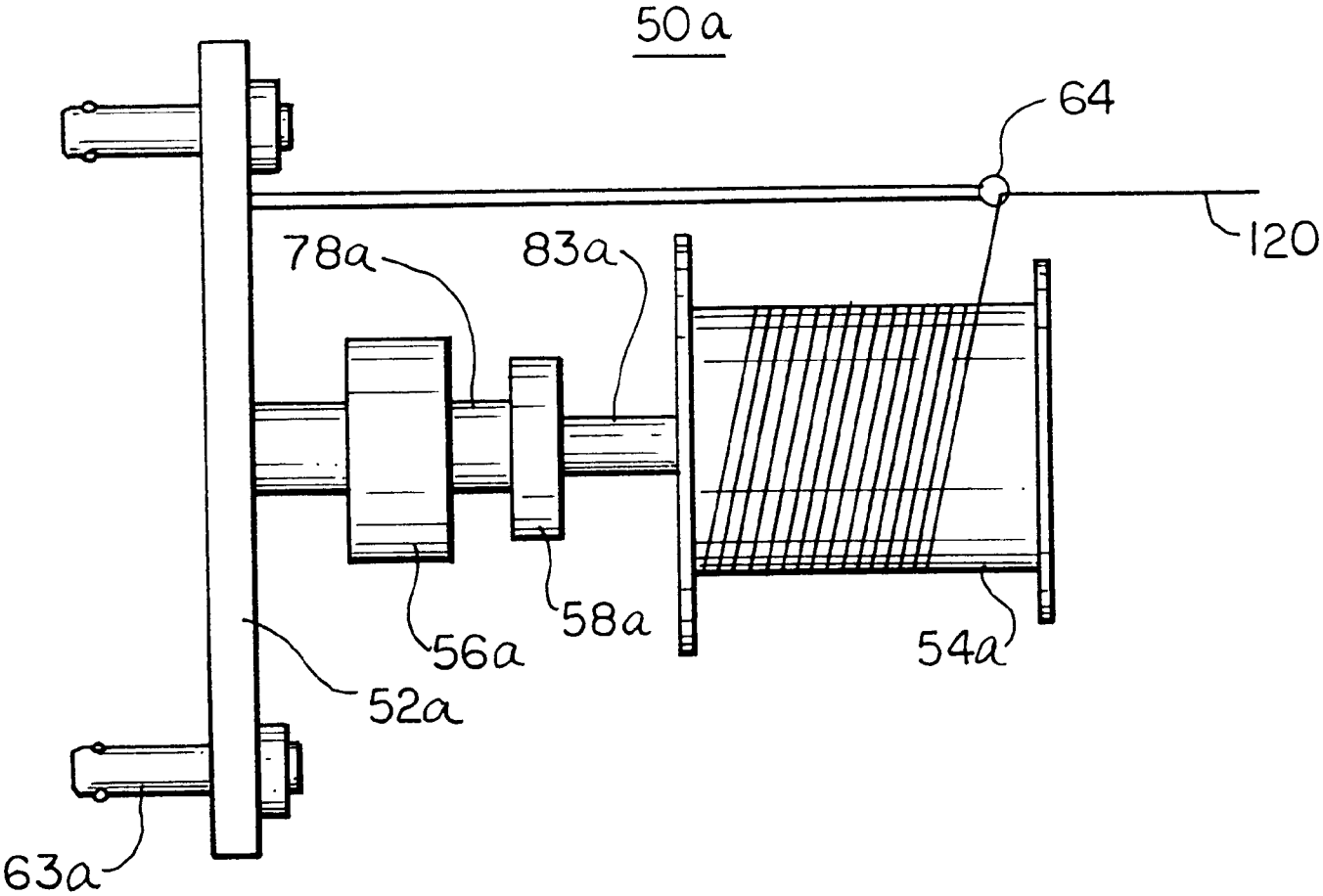
FIG. 4 is a schematic view of another embodiment of the direct feed braiding machine carrier of this invention with a vertical spool.

In an alternate embodiment, vertical carrier 50*a*, FIG. 4 includes frame 52*a* and fiber take-up assembly 56*a* coupled directly to clutch 58*a* via shaft 78*a*. Spool 54*a* is coupled to clutch 58*a* via shaft 83*a* and fiber 120 is fed off spool 54*a* through eyelet 64*a* under tension supplied by fiber take-up assembly 56*a*. Clutch 58*a* then allows additional fiber to fed out once take-up assembly reaches its maximum return limit. Carrier 50*a* is advantageous since there is no need for gear 68, 72, 76, and 74, FIG. 2: everything is coupled directly via shafts 78*a* and 83*a*.

Note, however, that although specific features of the invention are shown in some drawings and not others, this is for convenience only as some feature may be combined with any or all of the other features in accordance with the invention. And, other embodiments will occur to those skilled in the art and are within the following claims:

What is claimed is:

1. A braiding machine carrier comprising:

a frame;

a fiber spool mount attached to said frame;

a fiber take-up assembly for allowing the fiber spool mount to rotate in a first direction to pay out fiber during braiding up to a preset release tension and to rotate the fiber spool mount in a second opposite direction if there is any slack in the fiber;

means for mechanically connecting said fiber take-up assembly to said fiber spool mount; and clutch means, coupled to said fiber take-up assembly, for allowing the fiber take-up assembly to overcome the present release tension.

2. The carrier of claim 1 in which said fiber take-up assembly includes a spring which is wound as said spool rotates, said clutch means including means for preventing overwinding of said spring.

3. The carrier of claim 1 in which said means for mechanically connecting includes:

a fiber spool mount gear attached to the frame and connected to said fiber spool mount; and a take-up gear attached to the frame and connected to said fiber take-up assembly.

4. The carrier of claim 3 in which said means for mechanically connecting further includes an intermediate gear train mounted on said frame, said intermediate gear train having a first gear meshed with said take-up gear and a second gear meshed with said fiber spool mount gear.

5. The carrier of claim 1 further including a feed-eye affixed to said frame for guiding fiber directly off a spool mounted on said fiber spool mount.

6. The carrier of claim 1 in which said fiber spool mount includes a shaft rotatably affixed to said frame and a pair of spaced fiber spool seat members affixed to said shaft.

7. The carrier of claim 1 in which said clutch means includes a housing affixed to said frame and a shaft rotatable with respect to said housing and coupled to said fiber take-up assembly.

8. The carrier of claim 1 in which said fiber take-up assembly includes a shaft rotatably mounted with respect to said frame.

9. The carrier of claim 1 in which said clutch is a magnetic clutch.

10. The carrier of claim 9 in which said magnetic clutch includes variable tension settings.

11. The carrier of claim 1 further including a quick release mechanism for mounting said frame to a braiding machine.

12. A braiding machine carrier comprising:

a frame;

a fiber spool mount attached to said frame, said mount including a shaft rotatably affixed to said frame, and a pair of spaced fiber spool seat members affixed to said shaft;

a fiber take-up assembly including a spiral spring and a shaft rotatably mounted with respect to said frame;

means for coupling said fiber take-up assembly to said fiber spool mount for winding said spiral spring as a spool on said mount rotates; and a clutch, coupled to said take-up spring assembly, for preventing overwinding of said spring, said clutch coupled to said take-up spring assembly.

13. The braiding machine carrier of claim 12 in which said means for coupling said fiber take-up assembly to said fiber spool mount includes a take-up assembly gear on said fiber take-up assembly shaft, a fiber spool mount gear on said fiber spool mount shaft, and an intermediate gear train located on said frame between said fiber take-up spring assembly gear and said fiber spool mount gear.

14. The carrier of claim 13 in which said intermediate gear train includes a first gear meshed with said fiber take-up gear and a second gear meshed with said fiber spool mount gear.

15. A braiding machine carrier comprising:

a frame;

a fiber guide;

a fiber spool mount connected to said frame to feed fiber off a spool on said mount directly through said fiber guide; and means for automatically reversing the direction of the spool in response to slack in the fiber fed off the spool.

16. The carrier of claim 15 in which said means for automatically reversing includes a spiral spring which is wound as fiber is fed off the spool.

17. The carrier of claim 16 further including a clutch for preventing overwinding of said spiral spring.

18. The carrier of claim 17 in which said means for automatically reversing is connected to said mount by a gear train assembly.

19. The carrier of claim 18 in which said clutch is coupled directly to said means for automatically reversing.

20. The carrier of claim 17 in which said means for automatically reversing is connected to said frame and said mount is connected to said means for automatically reversing via said clutch.

21. A braiding machine carrier comprising:

a frame;

a fiber take-up assembly connected to said frame and including a shaft extending from the fiber take-up assembly in a direction opposite the frame;

a clutch coupled directly to the shaft of said fiber take-up assembly for preventing over-torquing of said fiber take-up assembly, the clutch including a shaft extending in a direction opposite the fiber take-up assembly; and a rotatable fiber spool mount coupled directly to the shaft of said clutch, whereby the fiber take-up assembly allows the fiber spool mount to rotate in a first direction to pay out fiber during braiding up to a preset release tension and to rotate the fiber spool mount in a second, opposite direction if there is any slack in the fiber.

* * * * *